US008157547B2

(12) United States Patent
Hendrikus Oude Vrielink

(10) Patent No.: US 8,157,547 B2
(45) Date of Patent: Apr. 17, 2012

(54) PERISTALTIC PUMP WITH FLOW CONTROL

(75) Inventor: Ronald Hermanus Hendrikus Oude Vrielink, Ee Delden (NL)

(73) Assignee: Bredel Hose Pumps B.V., Delden (NL)

( * ) Notice: Subject to any disclaimer, the term of this patent is extended or adjusted under 35 U.S.C. 154(b) by 771 days.

(21) Appl. No.: 11/789,032

(22) Filed: Apr. 23, 2007

(65) Prior Publication Data

US 2007/0258829 A1 Nov. 8, 2007

(30) Foreign Application Priority Data

Apr. 21, 2006 (NL) ..... 2000058

(51) Int. Cl.
*F04B 43/12* (2006.01)

(52) U.S. Cl. ..... 417/477.3

(58) Field of Classification Search ..... 417/411, 417/476, 477.1, 477.3, 477.4, 477.9, 477.6
See application file for complete search history.

(56) References Cited

U.S. PATENT DOCUMENTS

| | | | | | |
|---|---|---|---|---|---|
| 2,466,618 | A | * | 4/1949 | Stocks | 417/477.11 |
| 2,909,125 | A | * | 10/1959 | Daniels | 417/477.9 |
| 2,965,041 | A | * | 12/1960 | Clark | 417/63 |
| 3,335,670 | A | * | 8/1967 | Williams | 417/53 |
| 3,366,071 | A | * | 1/1968 | Dutler | 417/477.6 |
| 3,628,891 | A | * | 12/1971 | Isreeli et al. | 417/53 |
| 3,724,974 | A | * | 4/1973 | Molimard | 417/477.6 |
| 3,758,239 | A | * | 9/1973 | Hrdina | 417/477.11 |
| 4,165,954 | A | * | 8/1979 | Amos | 417/477.11 |
| 4,228,930 | A | | 10/1980 | Hogan | |
| 4,493,706 | A | * | 1/1985 | Borsanyi et al. | 604/153 |
| 4,564,342 | A | * | 1/1986 | Weber et al. | 417/477.6 |
| 4,735,553 | A | * | 4/1988 | Vidal | 417/33 |
| 5,230,614 | A | * | 7/1993 | Zanger et al. | 417/477.9 |
| 5,370,510 | A | * | 12/1994 | Sinclair et al. | 417/477.9 |
| 5,470,211 | A | * | 11/1995 | Knott et al. | 417/477.9 |
| 5,482,447 | A | * | 1/1996 | Sunden et al. | 417/477.12 |
| 5,645,727 | A | * | 7/1997 | Bhave et al. | 210/651 |
| 6,099,272 | A | * | 8/2000 | Armstrong et al. | 417/476 |
| 6,413,059 | B1 | * | 7/2002 | Pringle | 417/477.1 |
| 6,494,693 | B1 | * | 12/2002 | Sunden | 417/477.7 |
| 2002/0064470 | A1 | * | 5/2002 | Andersen et al. | 417/477.3 |

FOREIGN PATENT DOCUMENTS

| | | | |
|---|---|---|---|
| EP | 0013002 | A1 | 7/1980 |
| GB | 783884 | | 10/1957 |
| GB | 2076068 | A1 | 11/1981 |
| GB | 2290582 | | 1/1996 |
| GB | 2290582 | A | 3/1996 |
| SU | 1262106 | A1 | 7/1986 |
| SU | 1262106 | A * | 10/1986 |
| WO | 03/078836 | | 9/2003 |
| WO | 2004011810 | A1 | 2/2005 |
| WO | 2005086760 | A2 | 9/2005 |

* cited by examiner

*Primary Examiner* — Charles Freay
*Assistant Examiner* — Nathan Zollinger
(74) *Attorney, Agent, or Firm* — The Webb Law Firm

(57) ABSTRACT

A pump for circulating a medium comprising an elastically deformable hose against a pressing surface, and a medium inlet and a medium outlet; pressing elements that move along the hose and press the hose against a pressing surface thereby closing the hose. The pressing surface comprises an infeed part having a distance from the pressing elements that decreases from a first value when the hose is open to a second value when the hose is closed; an intermediate part having a constant distance from the pressing elements equal to the second value; and an outfeed part connected to the medium outlet. The length of the outfeed part and/or the infeed part is greater than the distance between the pressing elements as measured along the pressing surface.

15 Claims, 4 Drawing Sheets

PERISTALTIC PUMP WITH FLOW CONTROL

Figure 1:
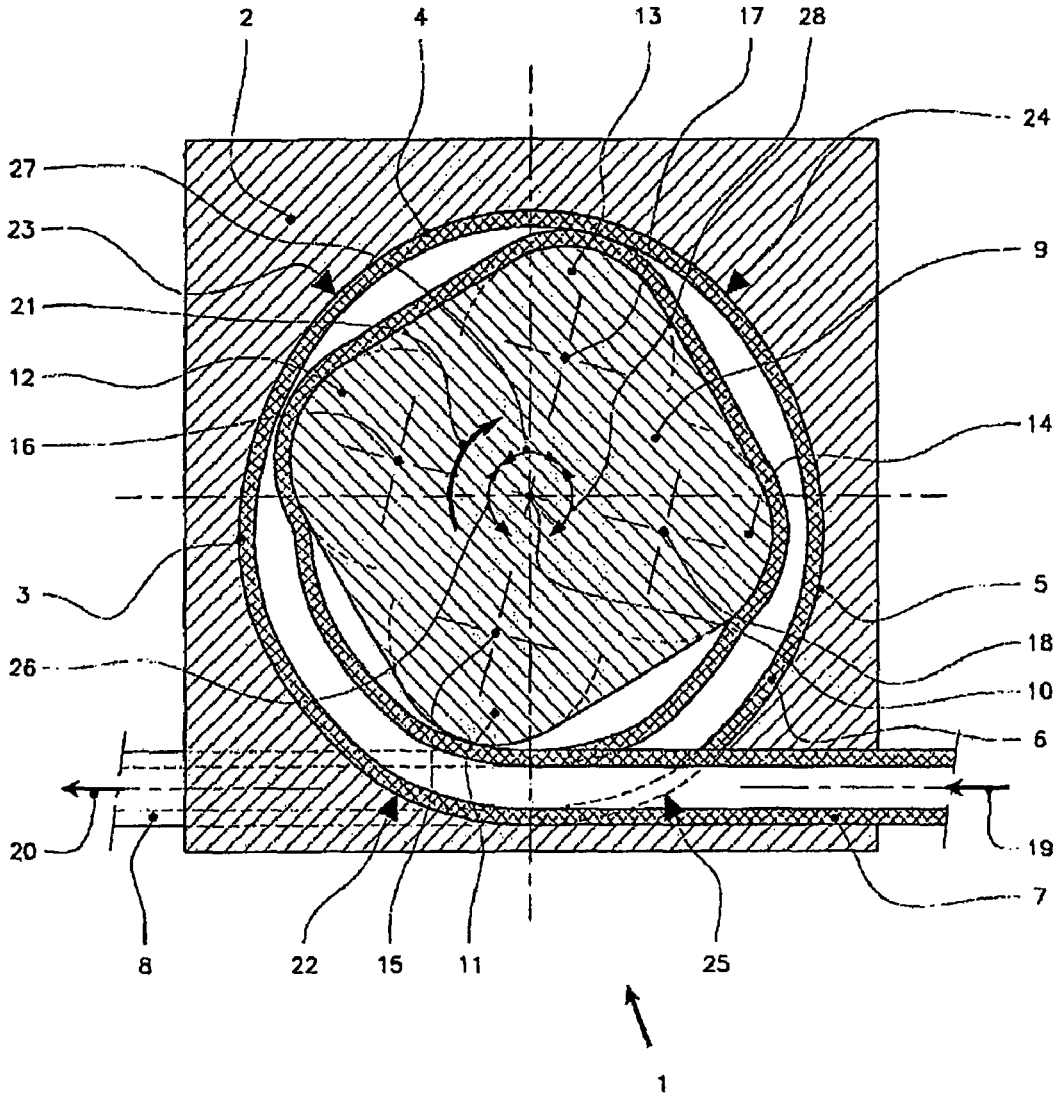
Figure 1A:
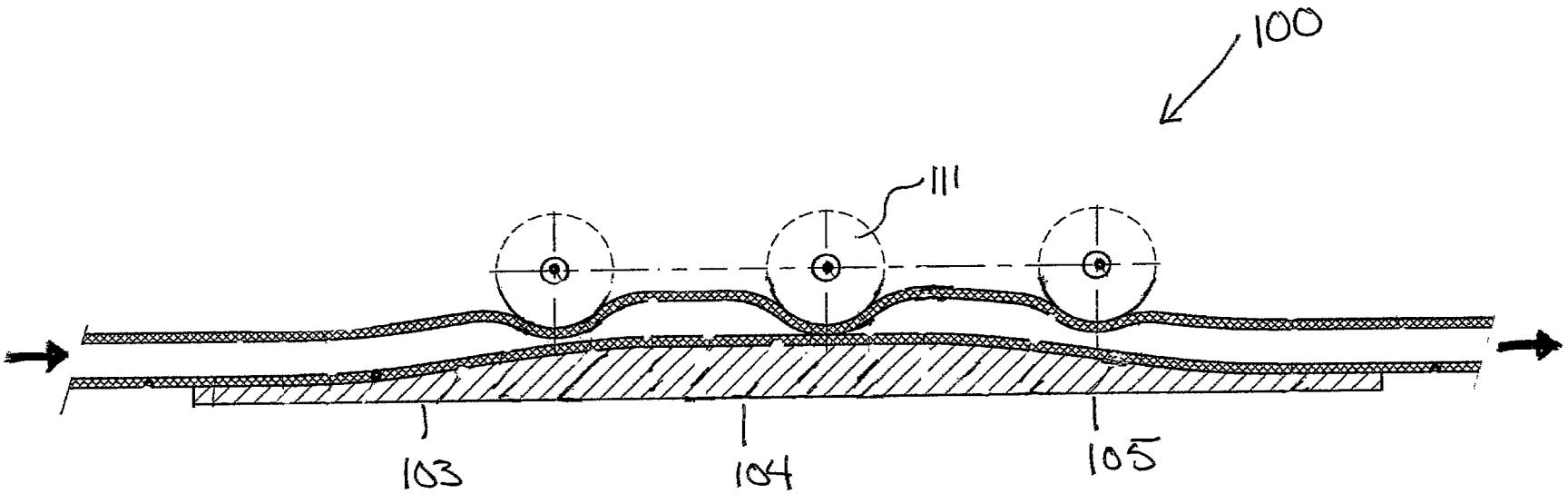
Figure 1B:
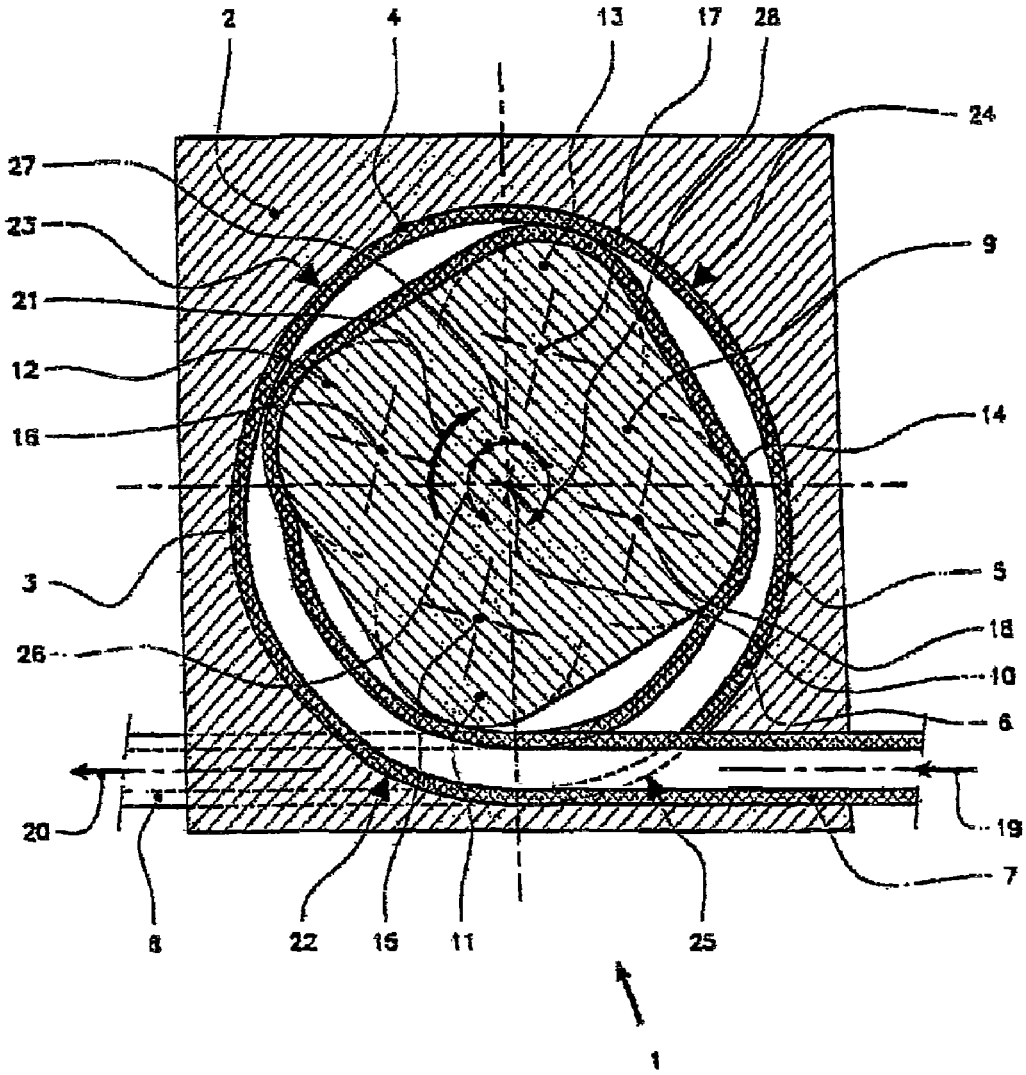

The invention relates to a peristaltic pump for circulating a medium, such as a liquid, a gas, a slurry, a granulate or a combination of two or more thereof, which pump comprises:

a pump housing;

a pressing surface present in this pump housing;

an elastically deformable hose, a part of which lies against the pressing surface, which hose has a medium inlet and a medium outlet;

pressing means with a number of equidistantly placed pressing elements such as cams or rollers;

which pressing means are drivable such that the pressing elements move along the hose; and which pressing elements during operation press the hose part in contact with the relevant pressing element against the pressing surface while locally compressing and closing the hose part;

this such that during driving of the pressing means medium is drawn in via the medium inlet and discharged under pressure via the medium outlet;

which pressing surface comprises:

an infeed part which connects to the medium inlet and the distance of which from the pressing elements decreases from a first value, at which the hose is substantially wholly undeformed and open when a pressing element is present, to a second value at which the hose is locally compressed and closed by a pressing element;

an intermediate part with a distance from the pressing elements which is substantially constant, this distance being equal to the second value; and an outfeed part, the distance of which from the pressing elements increases from the second value to the first value;

wherein the length of the outfeed part and/or the length of the infeed part is greater than the distance between the pressing elements as measured along the pressing surface.

Such a pump is for instance known from WO-A-03/078 836.

Owing to the local compression, and thereby closing of the hose by the respective pressing elements, and the displacement of this local compression under the influence of the pressing means driven along the hose, the medium present in the hose will be pushed along.

After a pressing element has passed, the form of the hose is restored due to its elastic properties. Owing to this mechanism medium is drawn into the hose on the suction side.

Because it is ensured that the hose is always pressed shut locally by at least one locally acting pressing element, the pump operates as closing valve such that the delivery side and the suction side are separated from each other. For this purpose the distance between the pressing elements, as measured along the pressing surface, is smaller than or equal to the length of the intermediate part.

When a pressing element approaches the end of the outlet side there occurs an increase in the volume of the hose at this outlet side. In a known peristaltic pump of the stated type this approach of the pressing elements to the end of the hose takes place in relatively rapid and uncontrolled manner. This results at the outlet side in a temporary change of speed in the medium flow. In the same manner there occurs a temporary change of speed at the inlet side. Due to acceleration and deceleration of the medium plugs at the inlet side and the outlet side there occur strong pressure fluctuations on both sides. This effect, which is known as pulsation, is undesirable for many applications of the pump. This effect for instance influences the dispensing accuracy of the volumetrically operating pump as well as the lifespan of the hose, among other reasons as a result of material fatigue. A further undesirable consequence of the pulsations are the undesired reactive forces on the conduits to which the pump is connected.

The pump known from said publication WO-A-03/078 836 is found to produce results which leave something to be desired.

It is in this respect an object of the invention to obviate to at least a significant extent the problem of said pressure fluctuations or pulsations in the known peristaltic pump.

Also decisive in obtaining minimum pulsations is the closing behaviour of the used hose under the influence of a passing pressing element. This closing behaviour is strongly influenced by the form of the hose. A round hose can for instance thus be designed such that under the influence of a pressing element it undergoes a "normal" flattening and compressing until it is completely closed. A hose can also be designed such that during compression the middle zones, which at rest are oriented respectively toward the pressing surface and the pressing means, lose contact with respectively the pressing surface and a pressing element during pressing such that, with the same mutual distance between a pressing element and the pressing surface, the passage for medium will be smaller than in the above mentioned case of the usual change in form.

Alternatively, a hose can also have a non-round form, whereby yet another closing characteristic is obtained.

This closing characteristic must be taken into account when making said choice in order to enable the strength of the pulsations to be controlled and, if desired, reduced to negligible proportions.

In respect of the above the invention provides a peristaltic pump of the type stated in the preamble which has the feature according to the invention that the length of the outfeed part and/or the length of the infeed part has a value lying between once and twice the distance between the pressing elements as measured along the pressing surface.

It is noted that from GB-A-2 290 582 a peristaltic pump of the rotating type is known wherein use is made of an inlet part and an outlet part, which parts have pressing surface parts located on a cylinder with a central axis corresponding to the rotation axis of the rotor. According to this publication, a specific form achieves that the hose undergoes a gradual change in form over both said zones, whereby according to the specification a reduction in the pulsations is achieved. It is noted here that it is possible according to the present invention to realize a sought-after optimum. It is thus possible to achieve for an "ideal" pump that the pulsations amount to almost nothing at both the inlet side and the outlet side. In the case where a customer is satisfied with a determined measure of pulsation at the inlet side and/or at the outlet side, the pump according to the invention can also be designed in the light of these specifications. In determined conditions it may even be desirable for certain pulsations to occur at the inlet side or at the outlet side.

According to the invention the design of the pump can thus be modified by means of a computer program to the requirements made of the pump on the basis of the technical-scientific requirements of a customer.

In order to avoid abrupt speed changes, and thereby correspondingly great accelerations, decelerations and forces manifesting themselves as pulsations, being able to occur in the medium and in the hose at the position of the transitions between the infeed part, the intermediate part and the outfeed part, the pump preferably has the special feature that the first derivative of the distance between the pressing elements and the pressing surface is continuous.

In a specific embodiment the pump has the special feature that the pump is of the linear type. "Linear" is understood to mean a pump wherein the pressing elements follow an at least more or less linear path along the pressing surface, which pressing surface likewise has an at least more or less linear form. It will be apparent that, in accordance with the teaching of the invention, the pressing surface has three parts, i.e. the infeed part, the intermediate part and the outfeed part. With the given basic principles according to the invention this pressing surface can have a form adapted thereto. Alternatively, the pressing surface can for instance be completely straight and the pressing elements can be guided along a contour surface such that said distance variation according to the teaching of the invention is realized.

A peristaltic pump is further known for circulating a medium, which pump is of the rotating type and comprises:

a pump housing;

a curved pressing surface which is present in this pump housing and at least a part of which takes the general form of a circular arc with a central axis;

an elastically deformable hose, of which a part lies against the pressing surface, which hose has a medium inlet and a medium outlet;

a rotor with a number of pressing elements, such as cams or rollers, placed at equal angular and radial positions;

which rotor is rotatingly drivable around a central axis; and which pressing elements during operation press the hose part in contact with the relevant pressing element against said pressing surface part while locally compressing and closing said hose part;

this such that during the rotation of the rotor medium is drawn in via the medium inlet and discharged under pressure via the medium outlet;

which pressing surface comprises:

an infeed part which connects to the medium inlet and the radial distance of which from the central axis decreases in the rotation direction of the rotor from a first value, at which the hose is substantially wholly undeformed and open when a pressing element is present, to a second value at which the hose is locally wholly compressed and closed by a pressing element;

an intermediate part, the radial distance of which from the central axis is substantially constant, this distance being equal to the second value; and an outfeed part, the radial distance of which from the central axis increases in the rotation direction of the rotor from the second value to the first value, and to which the medium outlet connects;

wherein the length of the outfeed part and/or the length of the infeed part is greater than the distance between the pressing elements as measured along the pressing surface.

This pump is particularly important in the context of the invention because such a pump, generally referred to as "hose pump", is very common and is highly suitable for adaptation in terms of the teaching of the present invention.

According to the invention this stated rotating peristaltic pump has the feature that the length of the outfeed part and/or the length of the infeed part has a value lying between once and twice the distance between the pressing elements as measured along the pressing surface.

It is noted that while this rotating pump has a construction other than for instance a linear pump according to the invention, the principles implemented therein are nevertheless the same. The results of the teaching according to the invention, i.e. the substantial reduction of the pulsations, can hereby also be easily realized in the rotating pump.

A preferred embodiment of a pump according to the invention has the special feature that the length of the infeed part is substantially equal to the length of the outfeed part.

In a determined embodiment the peristaltic pump according to the invention has the special feature that said length of the infeed part and/or the outfeed part is a minimum of about 5% greater, and in some embodiments 10% or 15% greater, than said distance. Using such an embodiment pulsations at the inlet side and/or the outlet side can be reduced to negligible proportions.

Very good results have been achieved with a test embodiment in which the difference between said length and said distance amounted to 17%.

Thus, in a pump in accordance with the present invention, the hose at each of the infeed part and/or the outfeed part is alternatingly contacted by one and two pressing elements as the pressing means or rotor travels over the infeed part and/or the outfeed part.

A substantial reduction in the amplitude of the fluctuations is already realized with an embodiment of the pump in which said length of the infeed part and/or the outfeed part is equal to a minimum of half the length of the intermediate part.

The pulsations are reduced to even smaller proportions with an embodiment in which the length of the infeed part and/or the outfeed part is substantially equal to the length of the intermediate part. In other embodiments, the length of the infeed part and or the outfeed part exceeds that of the intermediate part, for example by 10% or 20%.

A further embodiment has the special feature that, with a view to the mechanical properties of the hose, the form of the infeed part and/or the form of the outfeed part are chosen such that in any position of the pressing means the quotient of the displacement of the pressing means and the volume of the medium pumped as a result thereof is constant, and no pressure fluctuations occur in the medium inlet and/or in the medium outlet.

It is a further object of the invention to embody a peristaltic pump of the described type such that it can continue to operate, within the design tolerances, longer than usual pumps of this type.

As is known, any material displays a certain ageing. In a peristaltic pump this ageing is determined particularly by the number of compression and expansion cycles to which the hose is subjected by the pressing elements. After a number of cycles the expansion resilience will lessen due to ageing, this being associated with a change, and particularly a deterioration, in the pulsations.

The invention therefore also has for it object to substantially increase the effective lifespan of a pump.

The pump according to the invention has for this purpose the feature that the distance of the pressing means from the intermediate part of the pressing surface in the regions between the pressing elements has a value such that in these regions the hose is subjected to a pre-compression, whereby the throughflow surface area (S) is reduced to a value which amounts to a minimum of about 65% of the undisturbed throughflow surface area ($S_0$).

In a specific embodiment this pump has the feature that the value of the reduced throughflow surface area ($S/S_0$) amounts to about (80±10) %, i.e. is in the range 70% to 90%.

The invention also relates to the possibility of designing a peristaltic pump of the described type such that it can pump medium with very small, and in practice negligible pressure fluctuations, or can pump medium at a chosen value of the pressure fluctuations.

With a view hereto the invention also provides a peristaltic pump of the above described type which has the feature that the difference between said length and said distance is determined by designing the pump such that the quality factor is as great as possible, given determined preconditions and by selecting values for the relevant parameters, which quality factor is defined as the ratio between the average speed of the medium in the hose and the amplitude of the speed fluctuations or pulsations of the medium in the hose, wherein in order to make said choice account is taken of relevant design parameters of the group to which belong:

the distance of the pressing elements from the intermediate part of the pressing surface;

the form of the pressing elements;

the wall thickness of the hose;

the linear external dimensions of the hose;

the cross-sectional form of the hose;

the composition of the hose; and the mechanical properties of the hose.

Another parameter that has an influence on the service life of the hose is the maximum distance between the intermediate part of the pressing surface and a support surface of the pressing means between the pressing elements. By making this distance smaller than the unstressed diameter of the hose, the hose can be pre-compressed over the entire extent of the intermediate part, between the pressing elements.

Through repeated compression and causing the hose to expand again under the influence of its own resilience the hose is plastically deformed in the course of its life such that it is no longer able to take on its original form. This phenomenon is known as "compression set". This is manifested in practice as a loss of pump flow rate. By making said distance small in the described manner such that the hose is subjected to the pre-compression between the pressing elements, the hose is already forced into this final position at an early stage in its life. This measure also has a positive effect on the pulsations during the life of the hose. According to this aspect of the invention, the pulsations will increase less than when the hose is able to deform freely. The described quality hereby decreases less during the life of the hose, and the hose therefore meets its design specifications for a longer period.

It is also possible to eliminate the negative effect of the compression set by applying a method for stabilizing the flow rate of a peristaltic pump for circulating a medium, such as a liquid, a gas, a slurry, a granulate or a combination of two or more thereof, which pump comprises:

a pump housing;

a pressing surface present in this pump housing;

an elastically deformable hose, a part of which lies against the pressing surface, which hose has a medium inlet and a medium outlet;

pressing means with a number of equidistantly placed pressing elements such as cams or rollers;

which pressing means are drivable such that the pressing elements move along the hose; and which pressing elements during operation press the hose part in contact with the relevant pressing element against the pressing surface while locally compressing and closing the hose part;

this such that during driving of the pressing means medium is drawn in via the medium inlet and discharged under pressure via the medium outlet;

which pressing surface comprises:

an infeed part which connects to the medium inlet and the distance of which from the pressing elements decreases from a first value, at which the hose is substantially wholly undeformed and open when a pressing element is present, to a second value at which the hose is locally compressed and closed by a pressing element;

an intermediate part with a distance from the pressing elements which is substantially constant, this distance being equal to the second value; and an outfeed part, the distance of which from the pressing elements increases from the second value to the first value, which method comprises the following steps of:

(a) estimating or statistically determining, on the basis of a number of life tests of pumps which are substantially the same, the life expectancy of the pump expressed in or converted to the number of completed pump cycles;

(b) activating the pump after production of the pump; and (c) deactivating the pump once the pump, following step (b), has been in operation for a chosen fraction of the lifespan estimated or determined in step (a).

In a specific embodiment this method has the special feature that the fraction lies in the range of about 10-30%. After deactivation, the pump may be inspected to ascertain the condition of the hose or other components, and the hose or other components may be replaced if replacement is warranted by their condition. Alternatively, following deactivation, the hose or other components may be replaced without inspection or regardless of condition.

The pre-compression according to the invention is further intended to realize a number of advantages:

(a) during the life of the pump there occurs a smaller reduction in the pump flow rate expressed as the quotient of pumped volume and displacement of the pressing elements;

(b) there is a smaller variation in the remaining pulsations;

(c) pressure pulsation at higher counter-pressures is limited compared to the prior art.

The advantage (a) will be discussed later with reference to FIG. 2.

The following is noted by way of elucidation of advantages (b) and (c).

Hoses are flexible elements and are therefore not only able to draw in liquid but also, albeit to a limited extent, to buffer a certain volume. In the case of internal pressure this can cause a certain swelling of the hose. Buffering of liquid results in variations in the pump flow rate. The speed variations will hereby be reinforced, even in the case of a substantially pulsation-free pump.

As a consequence of the pre-compression according to the invention the freedom of the hose to swell is mechanically limited. The result is that the speed pulsations are reduced. The advantages are to be found particularly in the decreased strength of vibrations in the conduits connected to the pump, and in the pump itself.

The pre-compression provides for a flatter, so less variable, progression of the flow rate in time, for a more gradual progression in variations in counter-pressure, and thereby remaining pulsations. The optimal layout of the pump can be calculated for the situation where a fixed quantity of liquid is taken in per unit of time. Too large or too small a quantity of liquid results in the pump being operated outside its optimal operating range. Changes in the pulsations hereby occur both in respect of the speed and of the pressure.

The pulsation-free pump according to the invention enables the end user of the pump in many cases to suffice with a cheaper flow meter.

A known drawback of the prior art peristaltic pumps is the short negative liquid flow which occurs per half-rotation (at least in the case of a 180° or C-configuration with two pressing elements). For applications wherein a precise metering is required, this short-lived negative liquid flow is very undesirable. Only a few flow meters, most of which are of the mass flow (coriolis) type with a rapid advanced sampling and high filter frequencies, are able to measure these rapid flow rate variations. Because a pulsation-free pump according to the invention has a much smoother liquid flow, it is possible to suffice with a simpler type of flow meter, for instance of the magnetic or ultrasonic type. Use can be made of lower sampling frequencies. The filtering is less critical.

Mechanical flow meters can also be applied with the pump according to the invention. Since the liquid speed is after all always positive during use of the pump according to the invention, it is possible to suffice simply with counting of pulses. In the prior art pumps (particularly at lower displacing speeds of the pressing means) a negative liquid flow also creates generation of pulses. A rotating tachometer can after all not make a distinction between a positive or negative rotation direction, and therefore a positive or negative medium flow rate.

Figure 2:
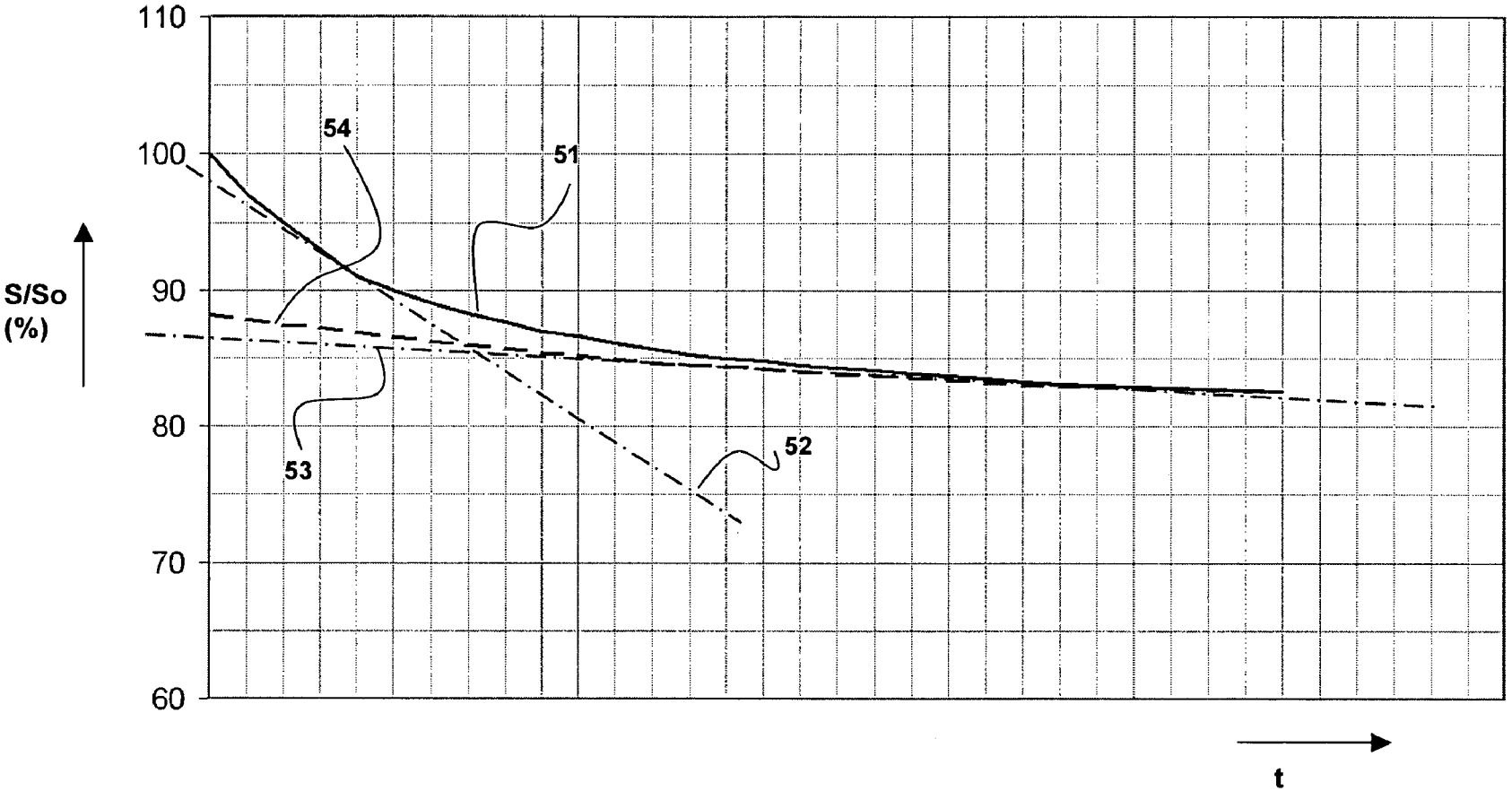

The invention will now be elucidated with reference to the accompanying drawings. In the drawings:

FIG. 1 shows a cross-section through a peristaltic pump 1 according to the invention of the rotating type; and FIG. 2 shows a graphic representation of the pump flow rate as a function of time for a prior art pump and a pump according to the invention.

FIG. 1 shows a cross-section through a peristaltic pump 1 according to the invention of the rotating type. Pump 1 comprises a pump housing 2; a curved pressing surface to be described hereinbelow present in this pump housing 2 and having three parts 3, 4, 5 respectively; an elastically deformable hose 6, a part of which lies against pressing surface 3, 4, 5, which hose 6 has a medium inlet 7 and a medium outlet 8; a rotor 9 with four pressing elements 11, 12, 13, 14 which are placed at mutual angles of 90° and equal radial positions relative to the central axis of rotor 10, and which in this embodiment are embodied as partly cylindrical cams with respective central axes 15, 16, 17, 18; which rotor 9 is rotatingly drivable around central axis 10 by means of drive means (not shown); and which pressing elements 11, 12, 13, 14 press during operation the part of hose 6 in contact with the relevant pressing element 11, 12, 13, 14 against said pressing surface 3, 4, 5 while locally compressing and closing the hose part; this such that during the rotation of the rotor medium is drawn in via medium inlet 7 and discharged under pressure via medium outlet 8. The indrawn medium is indicated with an arrow 19. The medium discharged under pressure is indicated with an arrow 20.

It will be appreciated that the rotor is polygonal with arcuate corners defining the pressing elements 11, 12, 13, 14. In the embodiment shown, the rotor 9 is generally square, but other polygonal forms are possible, such as hexagonal. The effect of this configuration is that the surface of the rotor between the pressing elements 11, 12, 13, 14, which surface is flat in the embodiment shown, remains in contact with the hose over the intermediate part 4 of the pressing surface, so as to pre-compress the hose 6 as will be discussed below.

As already noted, the pressing surface comprises three parts:

an infeed part 3 which connects to medium inlet 7 and the radial distance of which from the central axis 10 decreases in the rotation direction 21 of rotor 9 from a first value (arrow 22), at which hose 6 is substantially wholly undeformed and open when a pressing element 11 is present, to a second value (arrow 23) at which hose 6 is locally wholly compressed and closed by a pressing element 12;

an intermediate part 4, the radial distance of which from the axis is substantially constant (see arrows 23 and 24, wherein it is noted that the distance between pressing surface 4 and axis 10 is constant along this path); and an outfeed part 5, the radial distance of which from axis 10 increases in the rotation direction 21 of rotor 9 from the second value (arrow 24) to the first value (arrow 25).

In this exemplary embodiment said parts, i.e. infeed part 3, intermediate part 4 and outfeed part 5, extend through angles of 110°, 90° and 110°. These angles are designated with reference numerals 26, 27, 28, and it will be appreciated that these angles are equal to, or not more than 50% greater than, the angular pitch of the pressing elements 11, 12, 13. The first derivative of the distance between pressing elements 11, 12, 13 and pressing surface 3, 4, 5 is continuous, this being particularly important at the position of the transitions between infeed part 3 and intermediate part 4 and between intermediate part 4 and outfeed part 5.

FIG. 2 shows the effective operation of the pre-compression according to the invention.

As a consequence of their construction, material properties and continuously repeated deformation through compression, in particular at the position of the compression zones, hoses applied in peristaltic pumps display a gradually decreasing flow rate during their life. A typical flow rate curve 51 in time is shown in FIG. 2, wherein the full line shows curve 51 which would occur if no measures were taken in accordance with the teaching of the invention. The pre-compression is important, wherein the hose is pressed shut to some extent between the pressing surface and a pressing element. This has the purpose of creating a situation wherein at the beginning of the hose life the hose already produces a slightly lower flow rate than in the situation without pre-compression, but displays a relatively smaller drop in flow rate over the whole lifespan.

The tangent 52 on the standard curve 51 shows a strong drop in flow rate at the beginning of the hose life in the case of a prior art pump.

The tangent 53 on curve 54 for the hose according to the invention shows a comparatively very small drop in flow rate during the remainder of the life of the hose. The curves 51, 54 show that the improvement in the flatness of the flow rate curve is present particularly at the beginning of the life of the hose.

The more constant flow rate has by and large the following advantages:

- The metering properties of the pump are improved. Depending on the hose material applied, a minimal drop in flow rate can be achieved over the whole lifespan.
- Depending on the type of process and on the demanded metering precision, the pump can be utilized without flow meter.
- If calibration is necessary, it is possible to suffice with a lower measuring frequency. Particularly at the beginning of its life, the known pump displays a strong drop in flow rate. Calibration must then take place at relatively short intervals. The use of pre-compression according to the teaching of the invention can, depending on the desired accuracy, either make these regular calibrations wholly unnecessary or make it possible for the calibration frequency to be substantially reduced.

The invention claimed is:

1. A peristaltic pump for circulating a medium comprising:

a pump housing defining an interior space;

an elastically deformable hose having a part in contact with a pressing surface and having a medium inlet and a medium outlet;

a pressing means comprising a plurality of equally spaced pressing elements and a central axis, an angular pitch between the pressing elements remaining constant over one revolution of the pressing means;

wherein the pressing means are drivable such that the pressing elements move along the hose;

wherein the pressing elements press the part of the hose in contact with the pressing surface during operation thereby locally compressing and closing the part of the hose so that a medium under pressure is drawn in via the medium inlet and discharged via the medium outlet;

the pressing surface comprising: an infeed part connected to the medium inlet having a radial distance from the central axis of the pressing means that decreases from a first value at which the part of the hose in contact with the pressing elements is substantially open even when a pressing element is present, to a second value at which the part of the hose in contact with the pressing elements is substantially closed even when a pressing element is present; an intermediate part with a radial distance from the central axis of the pressing means which is substantially equal to the second value; and an outfeed part having a radial distance from the central axis of the pressing means that increases from the second value to the first value; wherein an angle of at least one of the following: the outfeed part or the infeed part, is greater than one and smaller than two times an angular pitch between the pressing elements.

2. The peristaltic pump as claimed in claim 1, wherein the pressing surface has a smooth transition between the infeed part, the intermediate part, and the outfeed part.

3. The peristaltic pump as claimed in claim 1, wherein the length of the infeed part is substantially equal to the length of the outfeed part.

4. The peristaltic pump as claimed in claim 1, wherein the length of at least one of the following: the infeed part or the outfeed part, is at least about 5% greater than the distance between the pressing elements as measured along the pressing surface.

5. The peristaltic pump as claimed in claim 4, wherein the length of at least one of the following: the infeed part or the outfeed part, is equal to a minimum of half the length of the intermediate part.

6. The peristaltic pump as claimed in claim 5, wherein the length of at least one of the following: the infeed part and or the outfeed part, is substantially equal to the length of the intermediate part.

7. The peristaltic pump as claimed in claim 1, wherein at any position of the pressing means, a quotient of a displacement of the pressing means and a volume of the medium pumped is substantially constant, wherein substantially no pressure fluctuations occur in the medium inlet or in the medium outlet.

8. The peristaltic pump as claimed in claim 1, wherein, in the intermediate part between areas where the hose is substantially closed, the hose is partially compressed to reduce a throughflow surface area to a minimum of about 65% of an uncompressed throughflow surface area.

9. The peristaltic pump as claimed in claim 8, wherein the hose is partially compressed to reduce the throughflow surface area to about (80 ±10) % of its uncompressed throughflow surface area.

10. The peristaltic pump as claimed in claim 1, wherein the difference between the length of at least one of the following: the outfeed part or the infeed part and the distance between the pressing elements is selected such that when the pump is operating, a ratio between an average speed of the medium in the hose and an amplitude of a speed fluctuation or pulsation of the medium in the hose is maximized.

11. The peristaltic pump as claimed in claim 1, wherein a distance between the pressing elements, as measured along the pressing surface, is smaller than or equal to the length of the intermediate part.

12. A peristaltic pump for circulating a medium comprising:

a pump housing defining an interior space;

an elastically deformable hose having a part in contact with a pressing surface and having a medium inlet and a medium outlet;

a pressing means comprising a plurality of equally spaced pressing elements and a central axis;

wherein the pressing means are drivable such that the pressing elements move along the hose;

wherein the pressing elements press the part of the hose in contact with the pressing surface during operation, thereby locally compressing and closing the part of the hose so that a medium under pressure is drawn in via the medium inlet and discharged via the medium outlet;

the pressing surface comprising: an infeed part connected to the medium inlet having a radial distance from the central axis of the pressing means that decreases from a first value at which the part of the hose in contact with the pressing elements is substantially open even when a pressing element is present, to a second value at which the part of the hose in contact with the pressing elements is substantially closed even when a pressing element is present; an intermediate part with a radial distance from the central axis of the pressing means which is substantially equal to the second value; and an outfeed part having a radial distance from the central axis of the pressing means that increases from the second value to the first value;

wherein, in the intermediate part between areas where the hose is substantially closed, the hose is partially compressed by the pressing means, which pressing means has such a distance from the intermediate part of the pressing surface in the regions between the pressing elements, that in these regions a throughflow surface area of the hose is reduced.

13. The peristaltic pump as claimed in claim 12, wherein an angle of at least one of the following: the outfeed part or the infeed part, is greater than one and up to two times an angular pitch between the pressing elements.

14. The peristaltic pump as claimed in claim 12, wherein, in the intermediate part between areas where the hose is substantially closed, the hose is partially compressed to reduce a throughflow surface area to a minimum of about 65% of an uncompressed throughflow surface area.

15. The peristaltic pump as claimed in claim 12, wherein the hose is partially compressed to reduce the throughflow surface area to about (80 ±10) % of its uncompressed throughflow surface area.

* * * * *